US009394670B2

(12) United States Patent
Hijikata et al.

(10) Patent No.: US 9,394,670 B2
(45) Date of Patent: Jul. 19, 2016

(54) CONSTRUCTION MACHINE

(71) Applicant: Hitachi Construction Machinery Co., Ltd., Bunkyo-ku, Tokyo (JP)

(72) Inventors: Seiji Hijikata, Tsukuba (JP); Kouji Ishikawa, Kasumigaura (JP); Takatoshi Ooki, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/611,318

(22) Filed: Feb. 2, 2015

(65) Prior Publication Data

US 2015/0218780 A1 Aug. 6, 2015

(30) Foreign Application Priority Data

Feb. 4, 2014 (JP) ..... 2014-019808

(51) Int. Cl.

| | |
|---|---|
| ***E02F 9/22*** | (2006.01) |
| ***E02F 9/20*** | (2006.01) |
| ***F15B 21/14*** | (2006.01) |
| *F15B 21/08* | (2006.01) |

(52) U.S. Cl.

CPC ..... *E02F 9/2221* (2013.01); *E02F 9/2095* (2013.01); *E02F 9/2217* (2013.01); *E02F 9/2228* (2013.01); *E02F 9/2285* (2013.01); *E02F 9/2296* (2013.01); *F15B 21/14* (2013.01);

(Continued)

(58) Field of Classification Search

CPC ..... E02F 9/2095; E02F 9/221; E02F 9/2285; E02F 9/2296; E02F 9/2217; B66C 13/20; F15B 21/14

USPC ..... 701/50; 475/1, 72; 60/677, 327, 470, 60/431, 459; 180/65.21, 65.285; 700/282; 123/2

See application file for complete search history.

(56) References Cited

U.S. PATENT DOCUMENTS

2012/0151905 A1* 6/2012 Lenton ..... B60W 10/06 60/327
2012/0285159 A1* 11/2012 Sugano ..... B66D 1/44 60/470
2013/0137547 A1* 5/2013 Ho ..... B60W 10/026 477/181

FOREIGN PATENT DOCUMENTS

EP 2 426 363 A1 3/2012
EP 2 672 127 A1 12/2013

(Continued)

OTHER PUBLICATIONS

European Search Report dated Jun. 22, 2015 (Seven (7) pages).

(Continued)

*Primary Examiner* — Marthe Marc-Coleman
(74) *Attorney, Agent, or Firm* — Crowell & Moring LLP

(57) ABSTRACT

Provided is a construction machine comprising an energy recovery device for recovering hydraulic fluid energy from a hydraulic actuator and being capable of achieving excellent operability even when the power of the prime mover is changed. The construction machine comprises an engine 1, a hydraulic pump 2, a plurality of hydraulic actuators 31-34, a plurality of control valves 41-44, a plurality of operating devices 71-74, an energy recovery device 80, an operation mode selector switch 76, an engine revolution speed dial 77, a pressure sensor 75, and a controller 90 which controls the flow rate of hydraulic fluid recovered by the energy recovery device based on input signals from the operation mode selector switch, the engine revolution speed dial and the pressure sensor.

12 Claims, 8 Drawing Sheets

(52) U.S. Cl.
CPC ..... *F15B 21/082* (2013.01); *F15B 2211/20523* (2013.01); *F15B 2211/40515* (2013.01); *F15B 2211/415* (2013.01); *F15B 2211/426* (2013.01); *F15B 2211/6316* (2013.01); *F15B 2211/6651* (2013.01); *F15B 2211/6658* (2013.01)

(56) References Cited

FOREIGN PATENT DOCUMENTS

| | | | |
|---|---|---|---|
| EP | 2 752 586 | A1 | 7/2014 |
| JP | 2-193899 | A | 7/1990 |
| JP | 2000-136806 | A | 5/2000 |
| JP | 2008-89023 | A | 4/2008 |
| JP | 2010-121726 | A | 6/2010 |
| JP | 2013-53499 | A | 3/2013 |
| WO | WO 2013/031768 | A1 | 3/2013 |

OTHER PUBLICATIONS

Japanese-language Office Action issued in counterpart Japanese Application No. 2014-019808 dated Feb. 2, 2016 (3 pages).

* cited by examiner

CONSTRUCTION MACHINE

BACKGROUND OF THE INVENTION

1. Field of the Invention

The present invention relates to a construction machine comprising hydraulic actuators, and in particular, to a construction machine comprising an energy recovery device for recovering the energy of the return hydraulic fluid from a hydraulic actuator.

2. Description of the Related Art

An energy recovery device for recovering the energy of the return hydraulic fluid from a hydraulic actuator is described in JP, A 2000-136806, for example.

JP, A 2000-136806 discloses an energy recovery device comprising a regeneration hydraulic motor which is driven by the return hydraulic fluid from a hydraulic actuator, an electric motor which is directly connected to the regeneration hydraulic motor, and an electrical storage device which stores electric power generated by the electric motor.

SUMMARY OF THE INVENTION

When performing an operation by using a construction machine, the operator of the construction machine generally operates the work implement (e.g., front work implement including a boom, an arm and a bucket) of the construction machine while setting the engine revolution speed at the maximum revolution speed. However, when the operator wants to move the work implement gently (e.g., fine operation) or to increase the fuel efficiency by suppressing the engine power, there are cases where the operator operates the work implement while setting the engine revolution speed at a low speed by adjusting an engine revolution speed dial to a low position or by switching an operation mode selector switch from a speed priority mode to a fuel efficiency priority mode, for example.

When the engine revolution speed is lowered in a standard type of construction machine, the delivery flow rate of the hydraulic pump decreases and the speeds of a plurality of hydraulic actuators for driving the work implement also drop by equivalent ratios. Therefore, if the operator performs a combined lever operation similar to that in the maximum revolution speed setting (i.e., when the engine revolution speed is set at the maximum revolution speed) while setting the engine revolution speed at a lower speed, the work implement operates similarly to the operation in the maximum revolution speed setting (operability in the combined operation does not deteriorate) except for the decrease in the speed of the operation.

In contrast, in construction machines in which a particular hydraulic actuator among the plurality of hydraulic actuators is equipped with the energy recovery device described in JP, A 2000-136806, the speed of the particular hydraulic actuator in the regeneration direction is determined not by the delivery flow rate of the hydraulic pump but by the regeneration flow rate of the regeneration hydraulic motor, and thus the speed does not change from the speed in the maximum revolution speed setting even if the engine revolution speed is set at a lower speed. Therefore, if a combined lever operation similar to that in the maximum revolution speed setting is performed by the operator while setting the engine revolution speed at a lower speed, the speeds of the other hydraulic actuators drop whereas the speed of the particular hydraulic actuator (equipped with the energy recovery device) in the regeneration direction does not drop. Consequently, the work implement operates differently from the operation in the maximum revolution speed setting (the operability in the combined operation deteriorates).

For example, when the engine revolution speed of a hydraulic excavator comprising the energy recovery device arranged on the bottom side of the boom cylinder has been set at a lower speed, if the operator attempts to perform the level push operation for pushing the bucket horizontally forward (combined operation of the boom lowering operation and the arm dump operation) with a combined lever operation similar to that in the maximum revolution speed setting, the boom lowering speed becomes too fast relative to the arm dump speed and thus there is a danger that the bucket hits the ground before being pushed horizontally forward.

It is therefore the primary object of the present invention to provide a construction machine comprising an energy recovery device for recovering the energy of the return hydraulic fluid from a hydraulic actuator and being capable of achieving excellent operability in the combined operation even when the power of the prime mover is changed.

(1) To achieve the above object, the present invention provides a construction machine comprising: a prime mover; a hydraulic pump which is driven by the prime mover; a plurality of hydraulic actuators which are driven by hydraulic fluid supplied from the hydraulic pump; a plurality of control valves which control flow rates of the hydraulic fluid supplied to the hydraulic actuators; a plurality of operating devices for operating the control valves; an energy recovery device including a regeneration hydraulic motor which is driven by return hydraulic fluid from a particular hydraulic actuator among the hydraulic actuators; a power adjustment device which adjusts the power of the prime mover to a value specified by an operator; an operation amount detection device which detects the operation amount of a particular operating device of the plurality of operating devices corresponding to the particular hydraulic actuator; and a control unit which controls the flow rate of the hydraulic fluid recovered by the regeneration hydraulic motor based on input signals from the power adjustment device and the operation amount detection device.

According to the present invention configured as above, excellent operability can be achieved even when the power of the prime mover is changed in a construction machine comprising an energy recovery device for recovering hydraulic fluid energy from a hydraulic actuator.

(2) Preferably, in the above construction machine (1), the prime mover is an engine, and the power adjustment device is engine revolution speed setting means for setting a target revolution speed of the engine.

(3) Preferably, in the above construction machine (2), the control unit performs the control so as to decrease the flow rate of the hydraulic fluid recovered by the regeneration hydraulic motor with the decrease in the target revolution speed set by the engine revolution speed setting means.

(4) Preferably, in the above construction machine (1), the prime mover is an engine, and the power adjustment device is operation mode selection means for setting a target revolution speed of the engine according to a selected operation mode.

(5) Preferably, in the above construction machine (4), when the selected operation mode is a low speed mode and a target revolution speed of the engine according to the low speed mode is set by the operation mode selection means, the control unit performs the control so as to decrease the flow rate of the hydraulic fluid recovered by the regeneration hydraulic motor.

(6) Preferably, in any one of the above construction machines (1)-(5), the energy recovery device further includes a generator/motor which is mechanically connected to the regeneration hydraulic motor. The control unit calculates a target flow rate of the return hydraulic fluid based on the input signals from the power adjustment device and the operation amount detection device and controls the revolution speed of the generator/motor so that the flow rate of the hydraulic fluid recovered by the regeneration hydraulic motor becomes equal to the target flow rate.

(7) Preferably, in any one of the above construction machines (1)-(5), the regeneration hydraulic motor is a variable displacement type hydraulic motor. The control unit calculates a target flow rate of the return hydraulic fluid based on the input signals from the power adjustment device and the operation amount detection device and controls displacement volume of the variable displacement type hydraulic motor so that the flow rate of the hydraulic fluid recovered by the variable displacement type hydraulic motor becomes equal to the target flow rate.

According to the present invention, excellent operability can be achieved even when the power of the prime mover is changed in a construction machine comprising an energy recovery device for recovering the hydraulic fluid energy from a hydraulic actuator.

DESCRIPTION OF THE PREFERRED EMBODIMENTS

Figure 1:
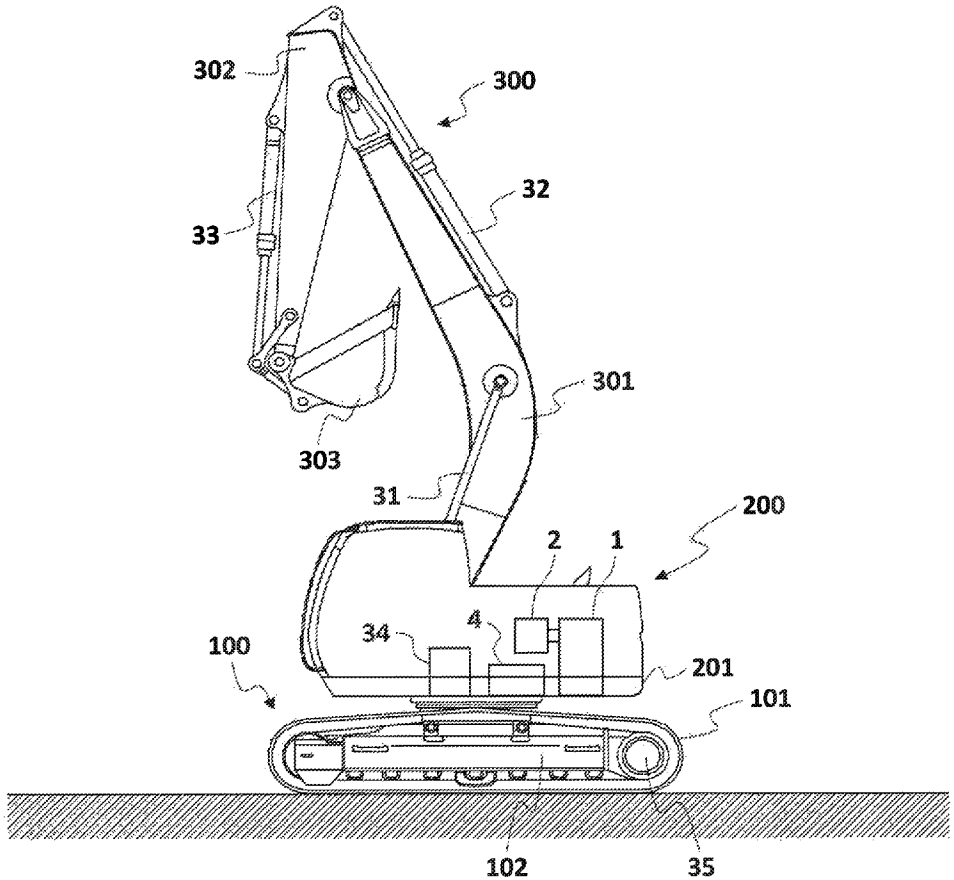
FIG. 1 is a schematic diagram showing the external appearance of a hydraulic excavator as an example of a construction machine in accordance with an embodiment of the present invention.

Referring now to the drawings, a description will be given in detail of preferred embodiments of the present invention.

<First Embodiment>

Configuration

A first embodiment of the present invention will be described below with reference to FIGS. 1-6.

FIG. 1 is a schematic diagram showing the external appearance of a hydraulic excavator as an example of a construction machine in accordance with an embodiment of the present invention. In FIG. 1, the hydraulic excavator comprises a lower track structure 100, an upper swing structure 200 and an excavation mechanism 300.

The lower track structure 100 includes a pair of crawlers 101 (only one side is illustrated), a pair of crawler frames 102 (only one side is illustrated), and a pair of travel hydraulic motors 35 (only one side is illustrated) each of which drives each crawler 101 independently.

The upper swing structure 200 includes a swing frame 201. Mounted on the swing frame 201 are an engine 1 as a prime mover, a hydraulic pump 2 which is driven by the engine 1, a swing hydraulic motor 34 which drives and swings the upper swing structure 200 (swing frame 201) with respect to the lower track structure 100, a control valve 4, and so forth.

The excavation mechanism 300 is attached to the upper swing structure 200 to be vertically rotatable. The excavation mechanism 300 includes a boom 301, an arm 302 and a bucket 303. The boom 301 is rotated vertically by the expansion/contraction of a boom cylinder 31. The arm 302 is rotated vertically (forward and backward) by the expansion/contraction of an arm cylinder 32. The bucket 303 is rotated vertically (forward and backward) by the expansion/contraction of a bucket cylinder 33.

Figure 2:
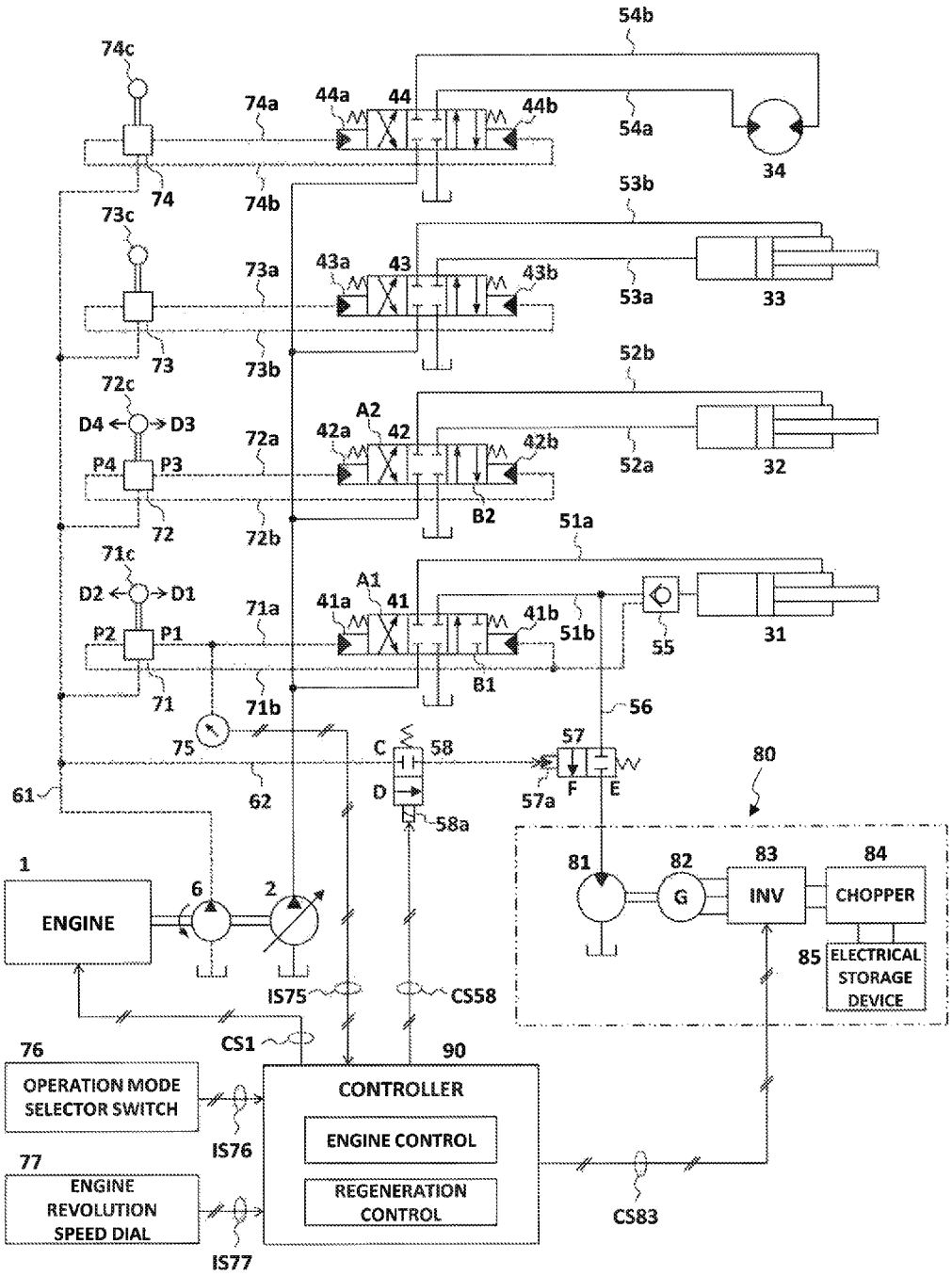
FIG. 2 is a schematic block diagram showing the overall configuration of a hydraulic control system which is installed in a hydraulic excavator as an example of a construction machine in accordance with a first embodiment of the present invention.

FIG. 2 is a schematic block diagram showing the overall configuration of a hydraulic control system which is installed in a hydraulic excavator as an example of a construction machine in accordance with a first embodiment of the present invention. The hydraulic control system shown in FIG. 2 includes the engine 1 (prime mover), the hydraulic pump 2, the boom cylinder 31, the arm cylinder 32, the bucket cylinder 33, the swing hydraulic motor 34, spool valves 41-44 arranged in the control valve 4 shown in FIG. 1, a pilot hydraulic pump 6, operating devices 71-74, an energy recovery device 80, and a controller 90 as a control unit. In FIG. 2, hydraulic circuitry for controlling the driving of other actuators (travel hydraulic motors, etc.) is unshown for the simplicity of illustration.

The hydraulic pump 2 is connected to the hydraulic actuators 31-34 via the spool valves 41-44 and actuator hydraulic lines 51*a*, 51*b*, 52*a*, 52*b*, 53*a*, 53*b*, 54*a* and 54*b*. When a spool valve 41-44 is operated leftward or rightward from the illustrated neutral position, the hydraulic fluid delivered from the hydraulic pump 2 is supplied to the corresponding hydraulic actuator 31-34 via a meter-in hydraulic line formed at a left or right position of the spool valve 41-44. Return hydraulic fluid discharged from each hydraulic actuator 32-34 other than the boom cylinder 31 is returned to a tank via a meter-out hydraulic line formed at a left or right position of the corresponding spool valve 42-44. Return hydraulic fluid discharged from a rod-side chamber of the boom cylinder 31 in the boom raising operation is returned to the tank via a meter-out hydraulic line formed at a left position A1 of the spool valve 41. No meter-out hydraulic line is formed at a right position B1 of the spool valve 41. Return hydraulic fluid discharged from a bottom-side chamber of the boom cylinder 31 in the boom lowering operation (hereinafter referred to as a "bottom flow") is returned to the tank via a regeneration hydraulic line 56 and the energy recovery device 80.

Left and right pilot pressure receiving parts 41*a*, 41*b*, . . . , 44*a* and 44*b* of the spool valves 41-44 are connected to output ports of the operating devices 71-74 via left and right pilot hydraulic lines 71*a*, 71*b*, . . . , 74*a* and 74*b*, respectively. Input ports of the operating devices 71-74 are connected to the pilot hydraulic pump 6 via pilot hydraulic lines 61. Each operating device 71-74 generates pilot pressure corresponding to the operation amount of its own control lever 71*c*-74*c* by using the delivery pressure of the pilot hydraulic pump 6 (hereinafter referred to as "pilot primary pressure") as the source pressure and outputs the generated pilot pressure to the corresponding ones of the pilot hydraulic lines 71*a*, 71*b*, . . . , 74*a* and 74*b*. The spool valves 41-44 are operated leftward or rightward from the illustrated neutral positions according to the pilot pressures supplied to their left and right pilot pressure receiving parts 41*a*, 41*b*, . . . , 44*a* and 44*b* via the pilot hydraulic lines 71*a*, 71*b*, . . . , 74*a* and 74*b*.

An actuator hydraulic line 51*b* connecting the bottom-side chamber of the boom cylinder 31 and the spool valve 41 together (hereinafter referred to as a "bottom-side hydraulic line 51*b*") is provided with a pilot check valve 55 which allows the flow in the direction for supplying the hydraulic fluid to the bottom-side chamber (boom raising direction) while blocking the flow in the direction for discharging the hydraulic fluid from the bottom-side chamber (boom lowering direction). The pilot check valve 55 is used for preventing accidental discharge of the hydraulic fluid from the bottom-side chamber of the boom cylinder 31 (accidental dropping of the boom). To the pilot check valve 55, boom-lowering pilot pressure P2 is led via a boom lowering pilot hydraulic line 71*b*. When the boom lowering pilot pressure P2 exceeds a prescribed pressure P2min (explained later), the pilot check valve 55 shifts to the open state and allows the flow in the boom lowering direction.

The boom lowering pilot hydraulic line 71*b* is provided with a pressure sensor 75. The pressure sensor 75 converts the boom lowering pilot pressure P2 (outputted from the operating device 71 when the control lever 71*c* is operated to the boom lowering side) into an electric signal and outputs the electric signal to the controller 90. The pressure sensor 75 constitutes an operation amount detection device which detects the operation amount of the control lever 71*c* (operating device 71) to the boom lowering side.

The energy recovery device 80 is connected to the bottom-side hydraulic line 51*b* via the regeneration hydraulic line 56. The regeneration hydraulic line 56 is provided with a pilot selector valve 57 which can be switched between the illustrated closed position (position E) and an open position (position F). A pilot pressure receiving part 57*a* of the pilot selector valve 57 is connected to the pilot hydraulic line 61 via a pilot hydraulic line 62. The pilot hydraulic line 62 is provided with a solenoid selector valve 58 which can be switched between the illustrated closed position (position C) and an open position (position D). A solenoid part 58*a* of the solenoid selector valve 58 is connected to the controller 90. When the solenoid selector valve 58 is switched from the illustrated closed position (position C) to the open position (position D) by a control signal CS58 from the controller 90, the pilot primary pressure is led to the pilot pressure receiving part 57*a* of the pilot selector valve 57 via the pilot hydraulic line 62. Accordingly, the pilot selector valve 57 is switched from the illustrated closed position (position E) to the open position (position F), by which the regeneration hydraulic line 56 connecting the bottom-side hydraulic line 51*b* to the energy recovery device 80 is opened.

The energy recovery device 80 includes a regeneration hydraulic motor 81 of the fixed displacement type connected to the regeneration hydraulic line 56, an electric motor 82 mechanically connected to the regeneration hydraulic motor 81, an inverter 83, a chopper 84, and an electrical storage device 85. The regeneration hydraulic motor 81 is driven and rotated by the bottom flow of the boom cylinder 31 supplied via the regeneration hydraulic line 56. The electric motor 82 rotates together with the regeneration hydraulic motor 81 and generates electric power. The electric power generated by the electric motor 82 undergoes voltage control by the inverter 83 and the chopper 84 and is stored in the electrical storage device 85. The electric power stored in the electrical storage device 85 is used for driving an assist electric motor (unshown) which assists the engine 1 in the driving, for example. The inverter 83 is connected to the controller 90 and controls the revolution speed of the electric motor 82 according to a control signal CS83 from the controller 90. By the revolution speed control of the electric motor 82, a regeneration flow rate of the regeneration hydraulic motor 81 (bottom flow rate of the boom cylinder 31) is controlled.

The hydraulic control system according to this embodiment is further equipped with an operation mode selector switch 76 and an engine revolution speed dial 77. The operation mode selector switch 76 is used for selecting the operation mode of the hydraulic excavator. In the hydraulic excavator of this embodiment, the operation mode can be selected from a high speed mode (operation speed priority mode), a middle speed mode and a low speed mode (fuel efficiency priority mode). The revolution speed of the engine 1 is set according to the selected operation mode. The engine revolution speed dial 77 is used for setting the revolution speed of the engine 1 between a minimum revolution speed Nmin and a maximum revolution speed Nmax. Each of the operation mode selector switch 76 and the engine revolution speed dial 77 constitutes a power adjustment device for adjusting the power of the engine 1 (prime mover).

The controller 90 generates control signals CS1, CS58 and CS83 for controlling the engine 1, the solenoid selector valve 58 and the inverter 83 by performing calculation processes on input signals IS75, IS76 and IS77 from the pressure sensor 75, the operation mode selector switch 76 and the engine revolution speed dial 77, and outputs the generated control signals CS1, CS58 and CS83 to the engine 1, the solenoid selector valve 58 and the inverter 83. According to the control signals CS1, CS58 and CS83, the revolution speed of the engine 1 and the regeneration flow rate of the regeneration hydraulic motor 81 (bottom flow rate of the boom cylinder 31) are controlled.

Control

Figure 3:
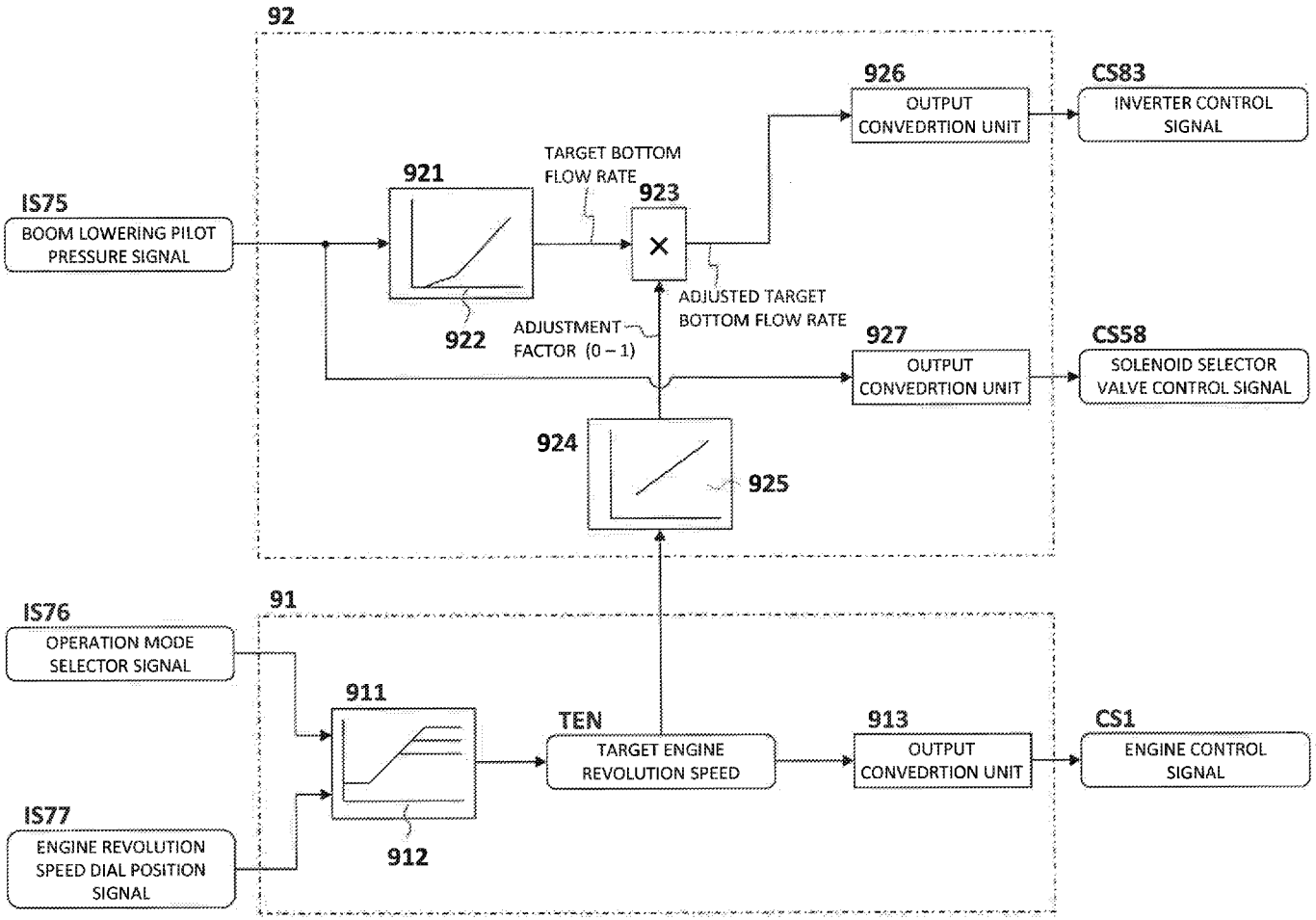
FIG. 3 is a schematic block diagram showing control blocks of a controller employed in the first embodiment.

FIG. 3 is a schematic block diagram showing control blocks of the controller 90. The control blocks of the controller 90 include an engine control block 91 (lower block in FIG. 3) and a regeneration control block 92 (upper block in FIG. 3).

First, the engine control block 91 will be explained below. The engine control block 91 is a block for controlling the revolution speed of the engine 1 shown in FIG. 2 according to the operation mode selector signal IS76 inputted from the operation mode selector switch 76 shown in FIG. 2 and the engine revolution speed dial position signal IS77 inputted from the engine revolution speed dial 77 shown in FIG. 2. The engine control block 91 includes a target engine revolution speed determination unit 911 and an output conversion unit 913. The target engine revolution speed determination unit 911 determines a target engine revolution speed TEN according to the operation mode selector signal IS76 and the engine revolution speed dial position signal IS77 by referring to a setting table 912 and outputs the determined target engine revolution speed TEN to the output conversion unit 913 and the regeneration control block 92.

Figure 4:
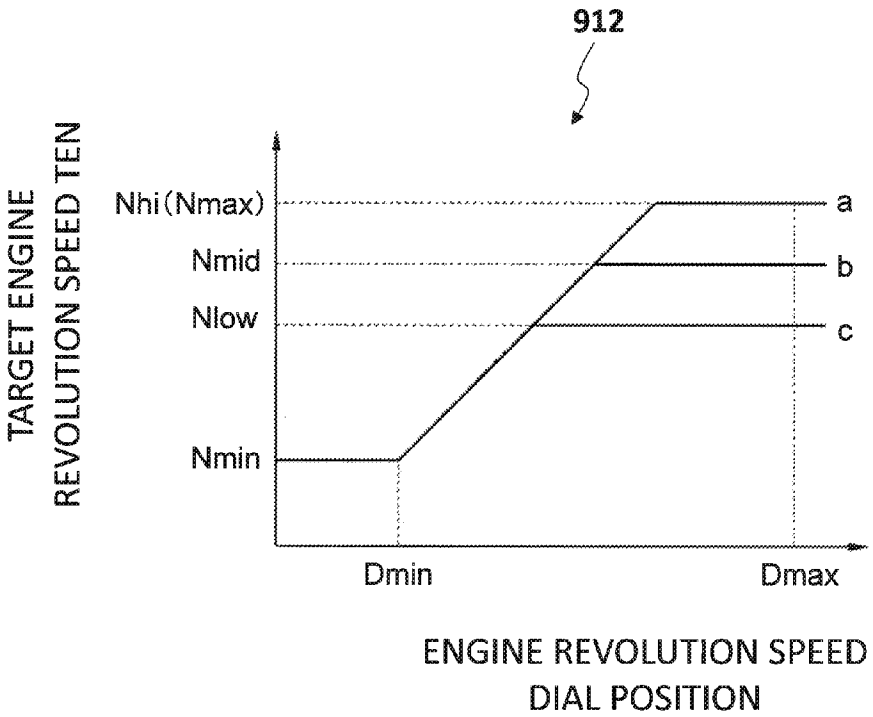
FIG. 4 is a graph showing the relationship between an engine revolution speed dial position and a target engine revolution speed.

FIG. 4 is a graph showing the details of the setting table 912 shown in FIG. 3. The setting table 912 is a table defining the correspondence between the engine revolution speed dial position and the target engine revolution speed in regard to each of the three operation modes (high speed mode a, middle speed mode b, low speed mode c). The setting table 912 has previously been stored in a memory in the controller 90 (shown in FIG. 2) or the like. In FIG. 4, when the engine revolution speed dial position is lower than a minimum position Dmin, the target engine revolution speed equals the minimum revolution speed Nmin in all the operation modes a-c. When the engine revolution speed dial position exceeds the minimum position Dmin, the target engine revolution speed increases with the dial position up to an upper limit revolution speed Nhi, Nmid or Nlow which has been set for each operation mode a-c. In this example, the upper limit revolution speed Nhi for the high speed mode a has been set at the maximum revolution speed Nmax of the engine 1.

Returning to FIG. 3, the output conversion unit 913 converts the target engine revolution speed TEN (input from the target engine revolution speed determination unit 911) into the engine control signal CS1 for controlling the engine revolution speed and outputs the engine control signal CS1 to the engine 1. According to the engine control signal CS1, the engine revolution speed is controlled to coincide with the target engine revolution speed TEN which has been determined based on the positions of the operation mode selector switch 76 and the engine revolution speed dial 77.

Next, the regeneration control block 92 will be explained below. The regeneration control block 92 is a block for controlling the regeneration flow rate of the regeneration hydraulic motor 81 (bottom flow rate of the boom cylinder 31) according to the boom lowering pilot pressure signal IS75 inputted from the pressure sensor 75 and the target engine revolution speed TEN inputted from the engine control block 91. The regeneration control block 92 includes a target bottom flow rate determination unit 921, a multiplication unit 923, an adjustment factor determination unit 924, and output conversion units 926 and 927. The boom lowering pilot pressure signal IS75 is inputted to the target bottom flow rate determination unit 921 and the output conversion unit 927. The target engine revolution speed TEN is inputted to the adjustment factor determination unit 924.

The target bottom flow rate determination unit 921 determines a target bottom flow rate corresponding to the boom lowering pilot pressure P2 by referring to a setting table 922 and outputs the determined target bottom flow rate to the multiplication unit 923.

Figure 5:
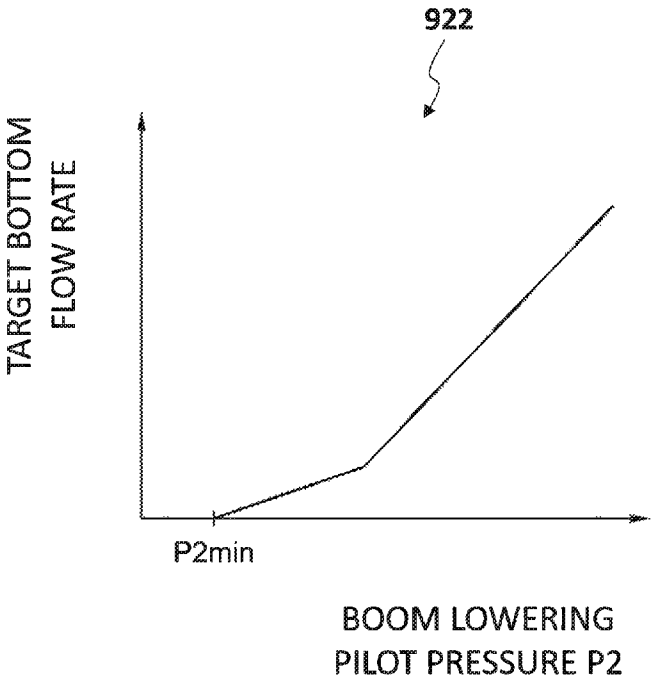
FIG. 5 is a graph showing the relationship between boom lowering pilot pressure and a target bottom flow rate.

FIG. 5 is a graph showing the details of the setting table 922 shown in FIG. 3. The setting table 922 is a table defining the correspondence between the boom lowering pilot pressure P2 and the target bottom flow rate. The setting table 922 has previously been stored in the memory in the controller 90 (shown in FIG. 2) or the like. The relationship between the boom lowering pilot pressure P2 and the target bottom flow rate shown in FIG. 5 is equivalent to a relationship in a case where the bottom flow rate of the boom cylinder 31 is controlled via the meter-out hydraulic line of an ordinary spool valve while setting the engine revolution speed at the maximum revolution speed Nmax. The target bottom flow rate equals 0 when the boom lowering pilot pressure P2 is lower than the prescribed pressure P2min. When the boom lowering pilot pressure P2 exceeds the prescribed pressure P2min, the target bottom flow rate increases with the boom lowering pilot pressure P2. Incidentally, the prescribed pressure P2min is set by the biasing force of a spring arranged in the spool valve 41 shown in FIG. 2.

Returning to FIG. 3, the output conversion unit 927 converts the boom lowering pilot pressure signal IS75 into the control signal CS58 for the solenoid selector valve 58 and outputs the control signal CS58 to the solenoid part 58*a* (shown in FIG. 2) of the solenoid selector valve 58. Specifically, when the boom lowering pilot pressure P2 is lower than the prescribed pressure P2min, the output conversion unit 927 outputs an OFF signal for switching the solenoid selector valve 58 to the closed position. When the boom lowering pilot pressure P2 exceeds the prescribed pressure P2min, the output conversion unit 927 outputs an ON signal for switching the solenoid selector valve 58 to the open position. Accordingly, when the control lever 71*c* of the operating device 71 is operated to the boom lowering side and the boom lowering pilot pressure P2 exceeds the prescribed pressure P2min, the solenoid selector valve 58 is switched to the open position and the pilot selector valve 57 is switched to the open position, by which the bottom-side hydraulic line 51*b* is connected to the energy recovery device 80.

The adjustment factor determination unit 924 determines an adjustment factor according to the target engine revolution speed TEN inputted from the engine control block 91 by referring to a setting table 925 and outputs the determined adjustment factor to the multiplication unit 923.

Figure 6:
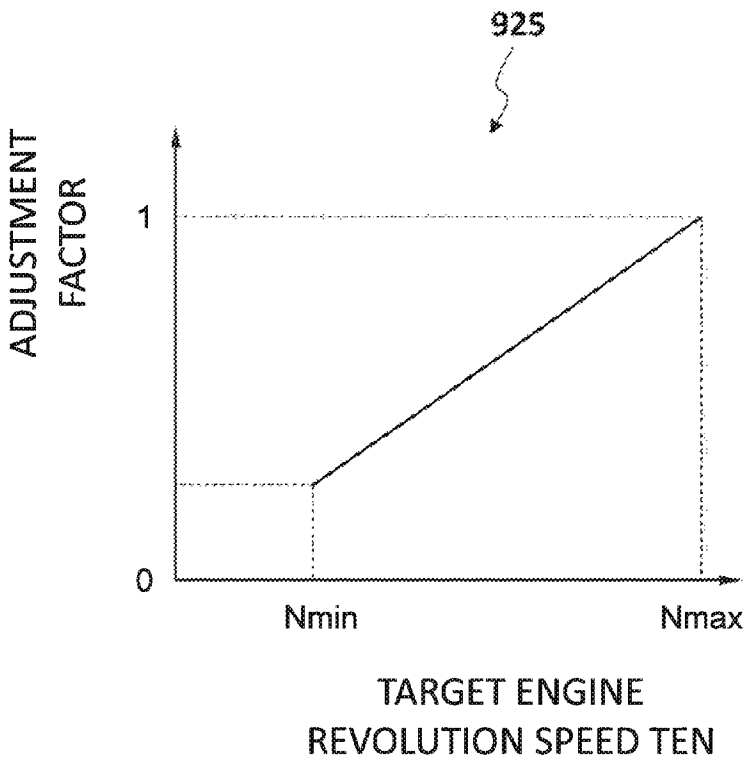
FIG. 6 is a graph showing the relationship between the target engine revolution speed and an adjustment factor of the target bottom flow rate.

FIG. 6 is a graph showing the details of the setting table 925 shown in FIG. 3. The setting table 925 is a table defining the correspondence between the target engine revolution speed TEN and the adjustment factor of the target bottom flow rate. The setting table 925 has previously been stored in the memory in the controller 90 (shown in FIG. 2) or the like. In FIG. 6, the adjustment factor equals 1 (maximum value) when the target engine revolution speed TEN is at the maximum revolution speed Nmax and decreases with the decrease in the target engine revolution speed TEN.

Returning to FIG. 3, the multiplication unit 923 multiplies the target bottom flow rate inputted from the target bottom flow rate determination unit 921 by the adjustment factor (0-1) inputted from the adjustment factor determination unit 924 and outputs the product (adjusted target bottom flow rate) to the output conversion unit 926. The output conversion unit 926 converts the adjusted target bottom flow rate inputted from the multiplication unit 923 into the inverter control signal CS83 and outputs the inverter control signal CS83 to the inverter 83. According to the inverter control signal CS83, the revolution speed of the electric motor 82 is controlled so that the regeneration flow rate of the regeneration hydraulic motor 81 coincides with the adjusted target bottom flow rate.

Operation

The operation of the hydraulic control system in the hydraulic excavator configured as above in a case where a level push operation (combined operation of the boom lowering operation and the arm dump operation) is performed with the operation mode selector switch 76 set at the high speed mode a and the engine revolution speed dial 77 set at its maximum position Dmax will be explained below.

Since the operation mode selector switch 76 has been set at the high speed mode a and the engine revolution speed dial 77 has been set at the maximum position Dmax, the target engine revolution speed determination unit 911 (shown in FIG. 3) outputs the maximum revolution speed Nmax as the target engine revolution speed TEN. Accordingly, the engine revolution speed is controlled to be at the maximum revolution speed Nmax.

In the level push operation, the operator operates the control levers 71*c* and 72*c* shown in FIG. 2 respectively in the boom lowering direction D2 and in the arm dump direction D4 while keeping an appropriate ratio between the operation amounts of the control levers 71*c* and 72*c* so that the bucket 303 shown in FIG. 1 is pushed horizontally forward. The operation amounts of the control levers 71*c* and 72*c* in this case will be represented as L2*h* and L4*h*, respectively. The boom lowering pilot pressure P2 and the arm dump pilot pressure P4 outputted from the operating devices 71 and 72 to the pilot hydraulic lines 71*b* and 72*b* will be represented as P2*h* and P4*h*, respectively.

When the spool valve 42 shifts to the illustrated right position (position B2) according to the arm dump pilot pressure P4*h*, the arm cylinder 32 contracts due to the hydraulic fluid supplied to its rod-side chamber according to the opening area of the meter-in hydraulic line and the hydraulic fluid discharged from its bottom-side chamber according to the opening area of the meter-out hydraulic line. The contracting speed of the arm cylinder 32 in this case will be represented as V2*h*.

When the spool valve 41 shifts to the illustrated right position (position B1) according to the boom lowering pilot pressure P2*h*, the hydraulic fluid is supplied to the head-side chamber of the boom cylinder 31 at a flow rate corresponding to the opening area of the meter-in hydraulic line. The pilot check valve 55 shifts to the open state due to the boom lowering pilot pressure P2*h* led thereto. The solenoid selector valve 58 is switched to the open position (position D) by the control signal CS58 from the controller 90. The pilot selector valve 57 is switched to the open position (position F) by the pilot primary pressure led to the pilot pressure receiving part 57*a* via the pilot hydraulic line 62. Due to the connection (opening) of the regeneration hydraulic line 56, the bottom flow of the boom cylinder 31 is recovered by the energy recovery device 80.

In this case, the target bottom flow rate determination unit 921 shown in FIG. 3 outputs a target bottom flow rate corresponding to the boom lowering pilot pressure P2*h* (corresponding to the operation amount L2*h* of the control lever 71*c*). The target engine revolution speed determination unit 911 outputs the maximum revolution speed Nmax as the target engine revolution speed TEN since the high speed mode a has been selected as the operation mode and the engine revolution speed dial position has been set at the maximum position Dmax. The adjustment factor determination unit 924 refers to the setting table 925 and outputs a value 1 as the adjustment factor corresponding to the target engine revolution speed TEN (corresponding to the maximum revolution speed Nmax). The multiplication unit 923 outputs the result of the multiplication of the target bottom flow rate by the adjustment factor 1 (corresponding to the target bottom flow rate). Accordingly, the bottom flow corresponding to the boom lowering pilot pressure P2*h* (corresponding to the operation amount L2*h* of the control lever 71*c*) is recovered by the energy recovery device 80 and the boom cylinder 31 contracts. The contracting speed of the boom cylinder 31 in this case will be represented as V1*h*.

Next, the operation in a case where the control levers 71*c* and 72*c* are operated in the same way (as in the case of the maximum revolution speed Nmax setting) with the operation mode selector switch 76 set at the low speed mode c and the engine revolution speed dial 77 set at the maximum position Dmax will be explained below. The following explanation will be given on the assumption that the pilot primary pressure is kept constant irrespective of the engine revolution speed and the pilot pressures outputted from the operating devices 71-74 according to the operation amounts of the control levers 71*c*-74*c* do not fluctuate with the engine revolution speed.

Since the operation mode selector switch 76 has been set at the low speed mode c and the engine revolution speed dial 77 has been set at the maximum position Dmax, the target engine revolution speed determination unit 911 shown in FIG. 3 outputs the upper limit revolution speed Nlow of the low speed mode c shown in FIG. 4 as the target engine revolution speed TEN. Accordingly, the engine revolution speed is controlled to be at the upper limit revolution speed Nlow of the low speed mode c.

When the spool valve 42 shifts to the illustrated right position (position B2) according to the arm dump pilot pressure P4*h*, a flow corresponding to the opening area of the meter-in hydraulic line is supplied to the rod-side chamber of the arm cylinder 32, causing the arm cylinder 32 to contract. In this case, the delivery flow rate of the hydraulic pump 2 also drops since the revolution speed of the engine 1 has been set at the upper limit revolution speed Nlow lower than the maximum revolution speed Nmax. Assuming that the delivery flow rate of the hydraulic pump 2 in this case drops to approximately 60% of the delivery flow rate in the maximum revolution speed Nmax setting, for example, the flow supplied to the rod-side chamber also drops to approximately 60%. Thus, the contracting speed of the arm cylinder 32 drops to approximately 60% of the contracting speed in the maximum revolution speed Nmax setting (approximately 0.6×V2*h*).

When the spool valve 41 shifts to the illustrated right position (position B1) according to the boom lowering pilot pressure P2*h*, a flow corresponding to the opening area of the meter-in hydraulic line is supplied to the head-side chamber of the boom cylinder 31. Similarly to the above case of the arm cylinder 32, the flow rate of the hydraulic fluid supplied to the head-side chamber of the boom cylinder 31 also decreases to approximately 60% of the flow rate in the maximum revolution speed Nmax setting.

Meanwhile, the bottom flow of the boom cylinder 31 is recovered by the energy recovery device 80 similarly to the case of the maximum revolution speed Nmax setting. In this case, the target bottom flow rate determination unit 921 shown in FIG. 3 outputs a target bottom flow rate corresponding to the boom lowering pilot pressure P2*h* (corresponding to the operation amount L2*h* of the control lever 71*c*) similarly to the case of the maximum revolution speed Nmax setting. The adjustment factor determination unit 924 refers to the setting table 925 and outputs a value 0.6 as the adjustment factor corresponding to the target engine revolution speed TEN (corresponding to the upper limit revolution speed Nlow of the low speed mode c). The multiplication unit 923 outputs the adjusted target bottom flow rate (=0.6×target bottom flow rate) as the result of the multiplication of the target bottom flow rate by the adjustment factor 0.6. Accordingly, the bottom flow recovered by the energy recovery device 80 drops to approximately 60% of the bottom flow in the maximum revolution speed Nmax setting and the contracting speed of the boom cylinder 31 also drops to approximately 60% of the contracting speed in the maximum revolution speed Nmax setting (approximately 0.6×V1*h*). Since the contracting speed of the arm cylinder 32 and the contracting speed of the boom cylinder 31 both drop to approximately 60% of the contracting speed in the maximum revolution speed Nmax setting (approximately 0.6×V2*h* and 0.6×V1*h*) as above, the level push operation is performed by lever operations similar to those in the maximum revolution speed Nmax setting. Incidentally, while the above explanation has been given of the level push operation, the same goes for other combined operations including the boom lowering operation.

Effect

In the hydraulic excavator according to the first embodiment configured as above, even when the combined operation is performed while setting the engine revolution speed at a speed lower than the maximum revolution speed, the speed of the hydraulic actuator equipped with the energy recovery device 80 (boom cylinder 31) at the time of the regeneration (boom lowering operation) and the speeds of the other hydraulic actuators 32-34 drop by equivalent ratios. Consequently, excellent operability can be achieved.

<Second Embodiment>

A second embodiment of the present invention will be described below with reference to FIGS. 7 and 8.

Figure 7:
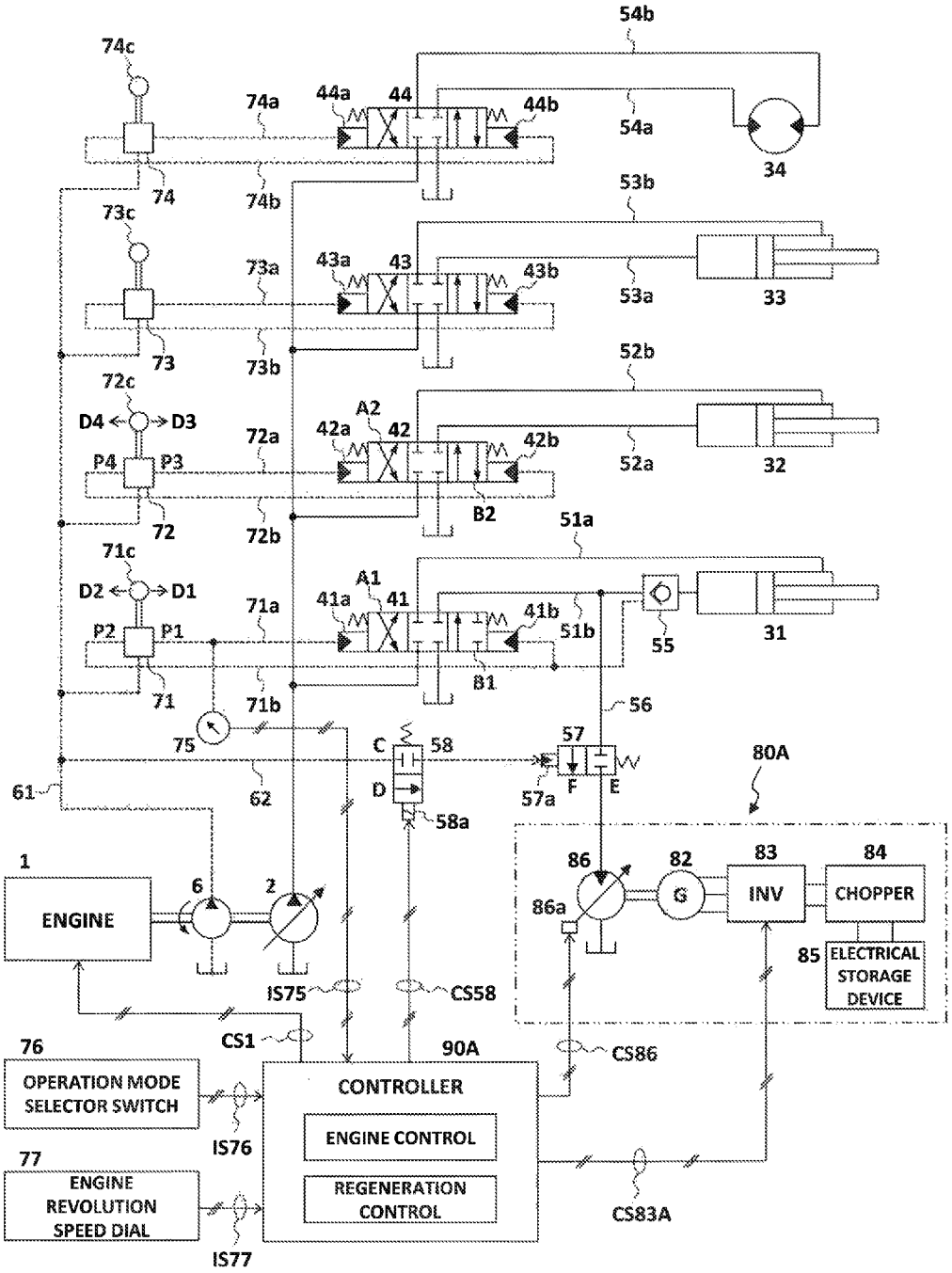
FIG. 7 is a schematic block diagram showing the overall configuration of a hydraulic control system which is installed in a hydraulic excavator as an example of a construction machine in accordance with a second embodiment of the present invention.

FIG. 7 is a schematic block diagram showing the overall configuration of a hydraulic control system which is installed in a hydraulic excavator as an example of a construction machine in accordance with the second embodiment. Referring to FIG. 7, the hydraulic control system in the second embodiment differs from the system in the first embodiment (FIG. 2) in that a regeneration hydraulic motor 86 of the variable displacement type having a tilting angle regulator 86*a* is employed instead of the fixed displacement type regeneration hydraulic motor 81 shown in FIG. 2 and the tilting angle regulator 86*a* is controlled by a control signal CS86 from a controller 90A provided instead of the controller 90 shown in FIG. 2.

Figure 8:
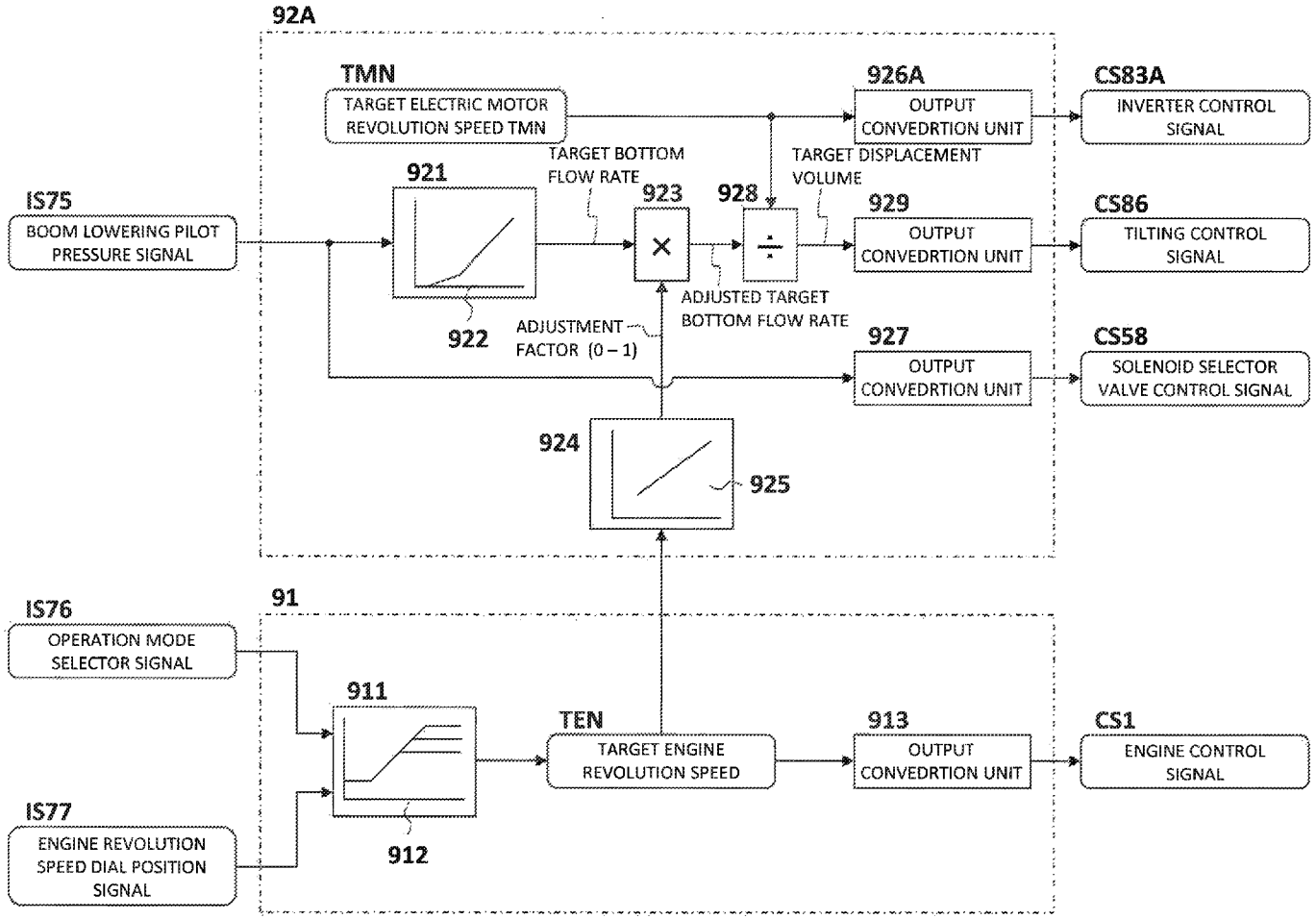
FIG. 8 is a schematic block diagram showing control blocks of a controller employed in the second embodiment.

FIG. 8 is a schematic block diagram showing control blocks of the controller 90A employed in this embodiment. In FIG. 8, differently from the controller 90 in the first embodiment shown in FIG. 3, the controller 90A in the second embodiment includes a regeneration control block 92A instead of the regeneration control block 92 shown in FIG. 3. Differently from the regeneration control block 92 shown in FIG. 3, the regeneration control block 92A in the second embodiment includes an output conversion unit 926A instead of the output conversion unit 926 shown in FIG. 3 and further includes a division unit 928 and an output conversion unit 929.

The output conversion unit 926A converts a preset target revolution speed of the electric motor 82 (hereinafter referred to as a "target electric motor revolution speed TMN") into an inverter control signal CS83A and outputs the inverter control signal CS83A to the inverter 83. According to the inverter control signal CS83A, the revolution speed of the electric motor 82 is controlled to coincide with the target electric motor revolution speed TMN.

The division unit 928 divides the adjusted target bottom flow rate inputted from the multiplication unit 923 by the target electric motor revolution speed TMN and outputs the quotient (adjusted target bottom flow rate/target electric motor revolution speed TMN) to the output conversion unit 929 as a target displacement volume of the variable displacement type regeneration hydraulic motor 86 per revolution. The output conversion unit 929 converts the target displacement volume into a tilting control signal CS86 for controlling the tilting angle regulator 86*a* and outputs the tilting control signal CS86 to the tilting angle regulator 86*a*. According to the tilting control signal CS86, the displacement volume of the variable displacement type regeneration hydraulic motor 86 is controlled to coincide with the target displacement volume.

In the hydraulic control system in this embodiment configured as above, the revolution speed of the electric motor 82 is controlled to coincide with the target electric motor revolution speed TMN and the displacement volume of the variable displacement type regeneration hydraulic motor 86 is controlled to coincide with the target displacement volume (=adjusted target bottom flow rate/target electric motor revolution speed TMN), by which the bottom flow rate of the boom cylinder 31 is controlled to coincide with the adjusted target bottom flow rate similarly to the first embodiment. Therefore, also in the hydraulic excavator according to this embodiment, effects similar to those in the first embodiment are achieved.

<Modifications>

The present invention is not to be restricted to the above-described first and second embodiments; a variety of modifications like those described below are possible.

1. The present invention is applicable also to hybrid hydraulic excavators (comprising an engine and an assistant electric motor as prime movers), electric hydraulic excavators (comprising an electric motor as a prime mover), etc. While the above embodiments have been described by taking a hydraulic excavator as an example of a construction machine, the present invention is of course applicable to other types of construction machines.

2. The construction machine may also be configured so that the regeneration hydraulic motor 81, 86 directly assists the engine 1 in the driving.

3. The construction machine may also be configured so that the regeneration hydraulic motor 81, 86 drives an assistant electric motor which assists the engine 1 or the swing hydraulic motor 34 in the driving.

4. The construction machine may also be configured so that the regeneration hydraulic motor 81, 86 drives a hydraulic pump and its hydraulic fluid energy is used for the driving of the hydraulic actuators directly or after being temporarily stored (pressure-accumulated) in an accumulator.

What is claimed is:

1. A construction machine comprising:

an engine;

a hydraulic pump which is driven by the engine;

a plurality of hydraulic actuators which are driven by hydraulic fluid supplied from the hydraulic pump;

a plurality of control valves which control flow rates of the hydraulic fluid supplied to the hydraulic actuators;

a plurality of operating devices for operating the control valves;

an energy recovery device including a regeneration hydraulic motor which is driven by return hydraulic fluid from a particular hydraulic actuator among the plurality of hydraulic actuators;

a power adjustment device which adjusts a revolution speed of the engine to a value specified by an operator;

an operation amount detection device which detects the operation amount of a particular operating device corresponding to the particular hydraulic actuator; and a control unit which controls the flow rate of the hydraulic fluid recovered by the regeneration hydraulic motor based on input signals from the power adjustment device and the operation amount detection device; wherein the control unit is configured to perform a control so as to decrease the flow rate of the hydraulic fluid recovered by the regeneration hydraulic motor with the decrease in the revolution speed of the engine.

2. The construction machine according to claim 1, wherein the power adjustment device is engine revolution speed setting device for setting a target revolution speed of the engine.

3. The construction machine according to claim 2, wherein:

the energy recovery device further includes a generator/motor which is mechanically connected to the regeneration hydraulic motor, and the control unit calculates a target flow rate of the return hydraulic fluid based on the input signals from the operation amount detection device and the power adjustment device and controls the revolution speed of the generator/motor so that the flow rate of the hydraulic fluid recovered by the regeneration hydraulic motor becomes equal to the target flow rate.

4. The construction machine according to claim 2, wherein:

the regeneration hydraulic motor is a variable displacement type hydraulic motor, and the control unit calculates a target flow rate of the return hydraulic fluid based on the input signals from the operation amount detection device and the power adjustment device and controls displacement volume of the variable displacement type hydraulic motor so that the flow rate of the hydraulic fluid recovered by the variable displacement type hydraulic motor becomes equal to the target flow rate.

5. The construction machine according to claim 1, wherein the power adjustment device is operation mode selection device for setting a target revolution speed of the engine according to a selected operation mode.

6. The construction machine according to claim 5, wherein when the selected operation mode is a low speed mode and a target revolution speed of the engine according to the low speed mode is set by the operation mode selection device, the control unit performs the control so as to decrease the flow rate of the hydraulic fluid recovered by the regeneration hydraulic motor.

7. The construction machine according to claim 6, wherein:

the energy recovery device further includes a generator/motor which is mechanically connected to the regeneration hydraulic motor, and the control unit calculates a target flow rate of the return hydraulic fluid based on the input signals from the operation amount detection device and the power adjustment device and controls the revolution speed of the generator/motor so that the flow rate of the hydraulic fluid recovered by the regeneration hydraulic motor becomes equal to the target flow rate.

8. The construction machine according to claim 6, wherein:

the regeneration hydraulic motor is a variable displacement type hydraulic motor, and the control unit calculates a target flow rate of the return hydraulic fluid based on the input signals from the operation amount detection device and the power adjustment device and controls displacement volume of the variable displacement type hydraulic motor so that the flow rate of the hydraulic fluid recovered by the variable displacement type hydraulic motor becomes equal to the target flow rate.

9. The construction machine according to claim 5, wherein:

the energy recovery device further includes a generator/motor which is mechanically connected to the regeneration hydraulic motor, and the control unit calculates a target flow rate of the return hydraulic fluid based on the input signals from the operation amount detection device and the power adjustment device and controls the revolution speed of the generator/motor so that flow rate the hydraulic fluid recovered by the regeneration hydraulic motor becomes equal to the target flow rate.

10. The construction machine according to claim 5, wherein:

the regeneration hydraulic motor is a variable displacement type hydraulic motor, and the control unit calculates a target flow rate of the return hydraulic fluid based on the input signals from the operation amount detection device and the power adjustment device and controls displacement volume of the variable displacement type hydraulic motor so that the flow rate of the hydraulic fluid recovered by the variable displacement type hydraulic motor becomes equal to the target flow rate.

11. The construction machine according to claim 1, wherein:

the energy recovery device further includes a generator/motor which is mechanically connected to the regeneration hydraulic motor, and the control unit calculates a target flow rate of the return hydraulic fluid based on the input signals from the operation amount detection device and the power adjustment device and controls the revolution speed of the generator/motor so that the flow rate of the hydraulic fluid recovered by the regeneration hydraulic motor becomes equal to the target flow rate.

12. The construction machine according to claim 1, wherein:

the regeneration hydraulic motor is a variable displacement type hydraulic motor, and the control unit calculates a target flow rate of the return hydraulic fluid based on the input signals from the operation amount detection device and the power adjustment device and controls displacement volume of the variable displacement type hydraulic motor so that the flow rate of the hydraulic fluid recovered by the variable displacement type hydraulic motor becomes equal to the target flow rate.

* * * * *